US005993316A

United States Patent [19]

Coyle et al.

[11] Patent Number: 5,993,316

[45] Date of Patent: Nov. 30, 1999

[54] SELECTIVE COIN AND GAME SLOT MACHINE

[76] Inventors: Jan R. Coyle, 7498 Old Highway 395, Carson City, Nev. 89704; William H. Avery, Jr., 1005 Apollo Way, Incline Village, Nev. 89451

[21] Appl. No.: 08/646,468

[22] Filed: May 8, 1996

Related U.S. Application Data

[63] Continuation-in-part of application No. 08/373,674, Jan. 17, 1995, abandoned.

[51] Int. Cl.[6] ..... A63F 9/22; A63F 1/00

[52] U.S. Cl. ..... 463/25; 463/12; 463/13; 273/138.2

[58] Field of Search ..... 273/143 R, 138.2, 273/269; 463/12, 13, 19, 20, 25, 26, 27, 29, 31

[56] References Cited

U.S. PATENT DOCUMENTS

| | | | |
|---|---|---|---|
| 4,948,134 | 8/1990 | Suttle et al. | 463/12 |
| 5,277,424 | 1/1994 | Wilms | 463/12 |
| 5,342,047 | 8/1994 | Heidel et al. | 463/29 |

FOREIGN PATENT DOCUMENTS

| | | | |
|---|---|---|---|
| WO85/00910 | 2/1985 | WIPO | 273/143 R |

*Primary Examiner*—Benjamin H. Layno
*Attorney, Agent, or Firm*—Newton H. Lee, Jr.

[57] ABSTRACT

A coin operated type gaming machine combines accepting multiple denomination coins of a selected currency, multiple kinds of games with different types of supplemental side bets, paying out of winnings in the same currency, configurable LCD input means for a selected game and networking capability.

7 Claims, 7 Drawing Sheets

SELECTIVE COIN AND GAME SLOT MACHINE

REFERENCE TO PRIOR APPLICATION

This application is a continuation-in-part of application, Ser. No. 08/373,674, filed Jan. 17, 1995 now abandoned.

BACKGROUND OF THE INVENTION

The coin operated gaming machine has evolved from a mechanical device into a microprocessor based electronic system. Most recent examples use color CRT screens to display the gaming action, with the mechanical aspects limited to the handling of the coins involved. Some of today's designs replicate mechanical and physical features of older, mechanical designs, but these are a stylistic overlay on what is fundamentally a modern, electronic system.

Most present coin operated gaming machines handle only one denomination and only local currency and consequently a casino usually installs separate machines for each popular denomination of a local currency. Player's desires for specific games and for the amount wagered tend to vary over the course of the day. Smaller denominations tend to be more popular during early daylight hours of the day, larger denominations tend to be more popular during the evening and night and early morning hours.

At any given time, a player's desire to play particular denominations of coins may not coincide with machine availability. Further, the various games have typically been available on a one machine/one game basis.

More recently, machines have evolved which offer multiple games on one machine, but such machines do not satisfy the need for savings of space and the convenience afforded by the ability to play multiple denominations of coins.

In the past, mechanical, illuminated push button switches have been used to instruct game programs, such as drawing or holding cards in the game of draw poker or taking a hit card or staying, in the game of black jack, as examples, and had permanently affixed markings on the buttons, making them unsuitable for multiple games. Touch responsive screens with their changeable legends, or blank buttons with directions displayed on a screen, deal with this difficulty, but they are expensive or awkward.

In International Publication WO85/00910 of Feb. 28, 1985 there is shown and described a gaming machine of the type employed for what is commonly known as a "fruit machine" or slot machine which accepts coins of two different currencies and pays out winnings in the opposite currency which enables the prior art slot machine to accept, for example, a coin of the currency of one country and pay out in coins of the currency of a different county. Such machines were adapted to accommodate travelers who desire to employ the currency of different countries and receive the pay out in the country of their destination and wherein means were contemplated to establish the necessary rates of conversion of the different currencies. However, such machines would not recognize play and winnings with different denominations of coins of the single local currency, or chips representing a currency common in a casino, for example.

In Wilms U.S. Pat. No. 5,277,424 granted Jan. 11, 1994, there is shown a video card gaming machine which allows for push button selection of the value or denomination of a bet to be made in the playing of the card game, but no provision is made or recognized for playing coins of different denominations by use of a plurality of coin receiving means which receive only the coins of a selected one of a plurality of denominations. Instead, the teaching of Wilms is that all money played is received in a single receptacle and the amount of the total money received which is to be bet is selected by pushing a selector button. Moreover, there is no recognition in Wilms of making any form of side bet.

However, in the play of certain card games, there exist opportunities to make wagers which involve adding to the total bet. For examples, in the playing of black jack there are side bet possibilities, including, without limitation, buying "insurance" against the dealer's black jack for which the player bets 50% of the initial wager; pairs may be split one or more times involving doubling the initial bet at each split; "doubling down" involving doubling the initial bet and receiving only one more card; and awaiting a separate wager which may be made that the first two cards are of the same suit. Other side bet opportunities exist in poker involving the cards as dealt or subsequently drawn.

Known coin operated gaming machines which do not have facility for accepting different coinage of the same currency do not facilitate "side bets", so as to more realistically represent playing card games at the usual table with chips or money of different values with a dealer who can make any necessary change for larger currency units.

SUMMARY OF THE INVENTION

The present invention overcomes the problem of single denomination machines by allowing a plurality of denominations of the same local currency to be used in a single machine.

In accomplishing the foregoing, the present invention provides for insertion of a plurality of coins of different denominations either in a typical so-called fruit machine or slot machine or in any of the more recently evolved games adapted to be played and displayed on a video screen and wherein typical coin currency receptors are provided for the different coins, or equivalently the currency receptor may be adapted to receive paper bills of different currencies or the machine may be adapted to receive a credit card in support of play in different denominations of the same local currency.

In a broad sense therefore, an object of the present invention is to provide a game machine capable of playing with different denominations of some local currency and to calculate and pay out winnings in that denomination of that currency whether in coin or in paper bills or credits.

In addition, the present invention contemplates the playing of a plurality of different games, such as, for example, poker and/or black jack or so-called fruit games at the same machine and at the election of the player who may select both the denomination of the currency to be played and the type of game to be played.

Further the present invention contemplates the playing of multiple games which are displayed on a video screen wherein a local area network interface is provided for the changing of games, as desired and the monitoring of machine activity at a central station.

In the specific form, the invention involves the use of a liquid crystal display (LCD) play board with buttons or pads which are capable of displaying the variable game instructions for playing the game selected by the player.

Still another object is to more nearly reproduce in a gaming machine the actual card games as played against a dealer and in which various side bets may be made. The side bet may be less than the original wager or more than the original wager, or, in addition to a wager. Different coins of the same currency facilitate achieving this object.

BRIEF DESCRIPTIONS OF THE DRAWINGS

DESCRIPTION OF THE PREFERRED EMBODIMENT

Figure 1:
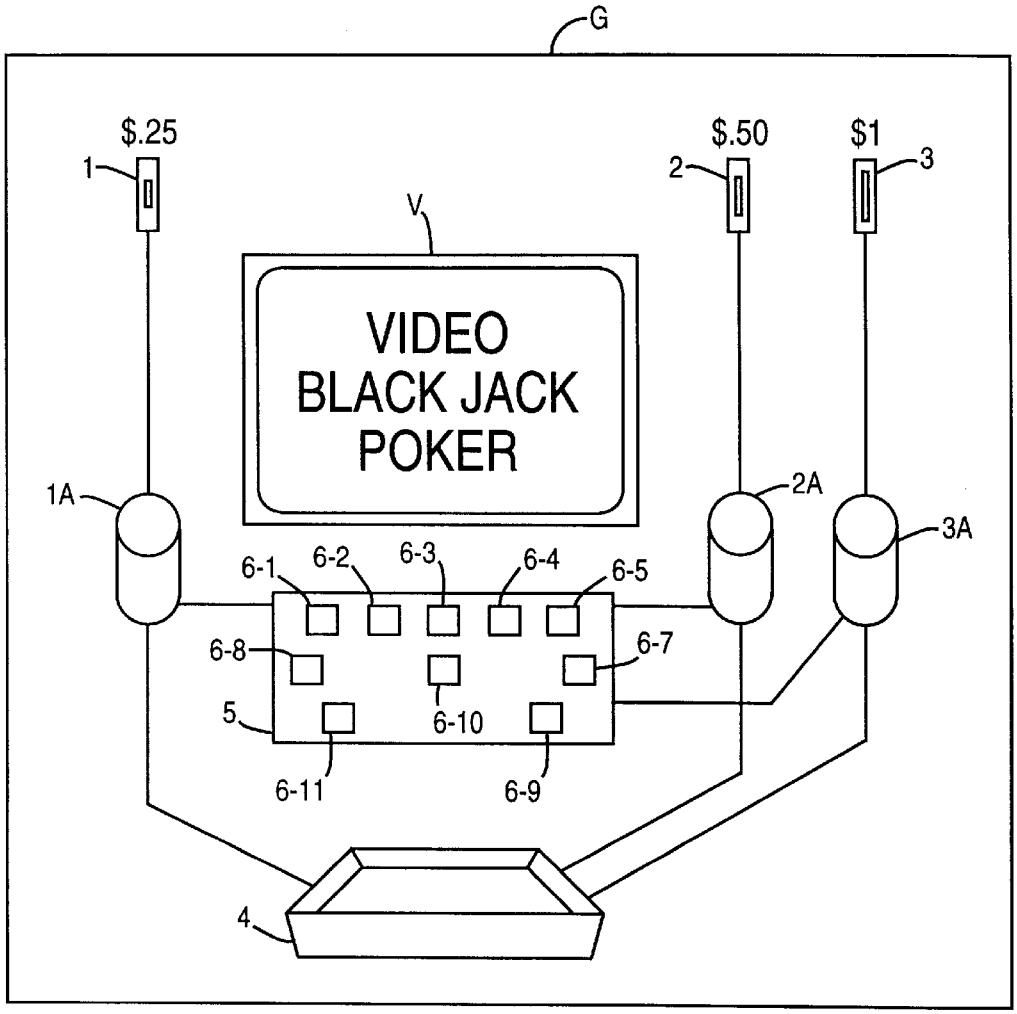
FIG. 1 is a view generally illustrating a game machine incorporating the invention.

Referring to FIG. 1 there is generally illustrated a game machine G adapted to play multiple games and receive coins of multiple denominations as well as to pay out in the same denomination as played or accrue play credits based upon the multiple coin denominations as may be selected by the player. More specifically, the game machine G is illustrated as a video game machine having a video display unit V providing game display means on which may be displayed the game selected by the player, such as poker or black jack, for example.

Coin input devices 1, 2 and 3 are illustrated, providing means, respectively adapted to receive coins of multiple currency denominations, comprising as shown, three denominations of the same local currency, $0.25, $0.50 and $1.00, although other coin denominations may be utilized. In typical casinos the most popular current coin operated games are adapted to receive coins in denominations of $0.25 or $1.00. However, it has been found that the machines for play with $0.25 are very popular early during the course of the daylight hours, while machines adapted for play with $1.00 coins are more popular later in the evening and during the night time hours into the very early morning hours.

The machine includes means including coin receptors 1A, 2A and 3A to which coins inserted into the selective slots are received and which, as will be later described, include means adapted to cause pay out of winnings to a receiver tray or hopper 4 depending upon the denomination of coins played and the number of coins to be paid out responsive to a winning play or side bet.

Means for manually directing the playing of the game displayed by the display unit are shown, in the form of a play control board 5, associated with the video display unit and with the various coin receptors. The play control board means 5 is provided with an array of combined operating and display push buttons or pads 6 adapted to enable manual control of the game to selectively determine which game will be played and the operative coin to be inserted, as well as various optional side bets.

The control buttons or pads are preferably in the form of liquid crystal displays (LCD) and depending upon the nature of the game being displayed, are adapted to display in the touchable area of the button or pad various indicia related to a selected game, the selected coinage and the various operations available in the play of one of the games illustrated on the video screen, including the display of an opportunity to consider making one or more of a variety of side bets appropriate to the selected game.

For example, in the play of a game of draw poker in which five cards are displayed upon the screen pads 6-1 through 6-5 are individually operable by the player to instruct the game to "HOLD" one or more of the five cards displayed on the screen following instructions by the player applied to a pad 6-7 to either "DEAL" or "DRAW" cards.

One of the buttons or pads 6-8 may be employed as a button displaying a selected coin denomination for betting, or the coin bet may be determined by means simply responsive to inserting a coin of a preferred denomination. A button or pad 6-9 may instruct the player to select the type of game to be played, say, in the event that the player desires to play black jack in lieu of draw poker or to instruct the player to consider making a side bet. In either case, a button or pad 6-10 may be employed to determine the amount of coinage of any selected denomination to be bet, or as will be later understood, to place a bet from the usual bet credit register in which winning may be recorded if desired. If it is desired that the machine be instructed to pay out winnings, then a button or "PAY" pad 6-11 may be used to so instruct the machine so that coins from one of the receptors 1A, 2A or 3A will be dispensed to the receiver tray 4.

In the event that the player should select the game of black jack, buttons or pads 6-1 through 6-5 may be used to display 5 options available in the playing of black jack depending upon the cards that the player has initially received, namely "STAY", "HIT", "SPLIT", "DOUBLE" and "INSURANCE". Split, double, insurance, as well as a bet on cards of the same suit are all known side bets which require playing or inserting additional coins for the purpose of increasing a wager.

In a preferred form of the black jack game, since the buttons or pads are LCD displays, the only displays activated may be those related to the optional plays available to the player, depending upon the cards that the player has received, which is to say, that if the players hand is not susceptible to being split, button or pad 6-3 may be blank and if the dealer does not have a potential "Black Jack", the insurance button or pad 6-5 may remain blank. However, depending upon specific cards and circumstances, the player is afforded the opportunity to make appropriate side bets as later more fully described.

Figure 2:
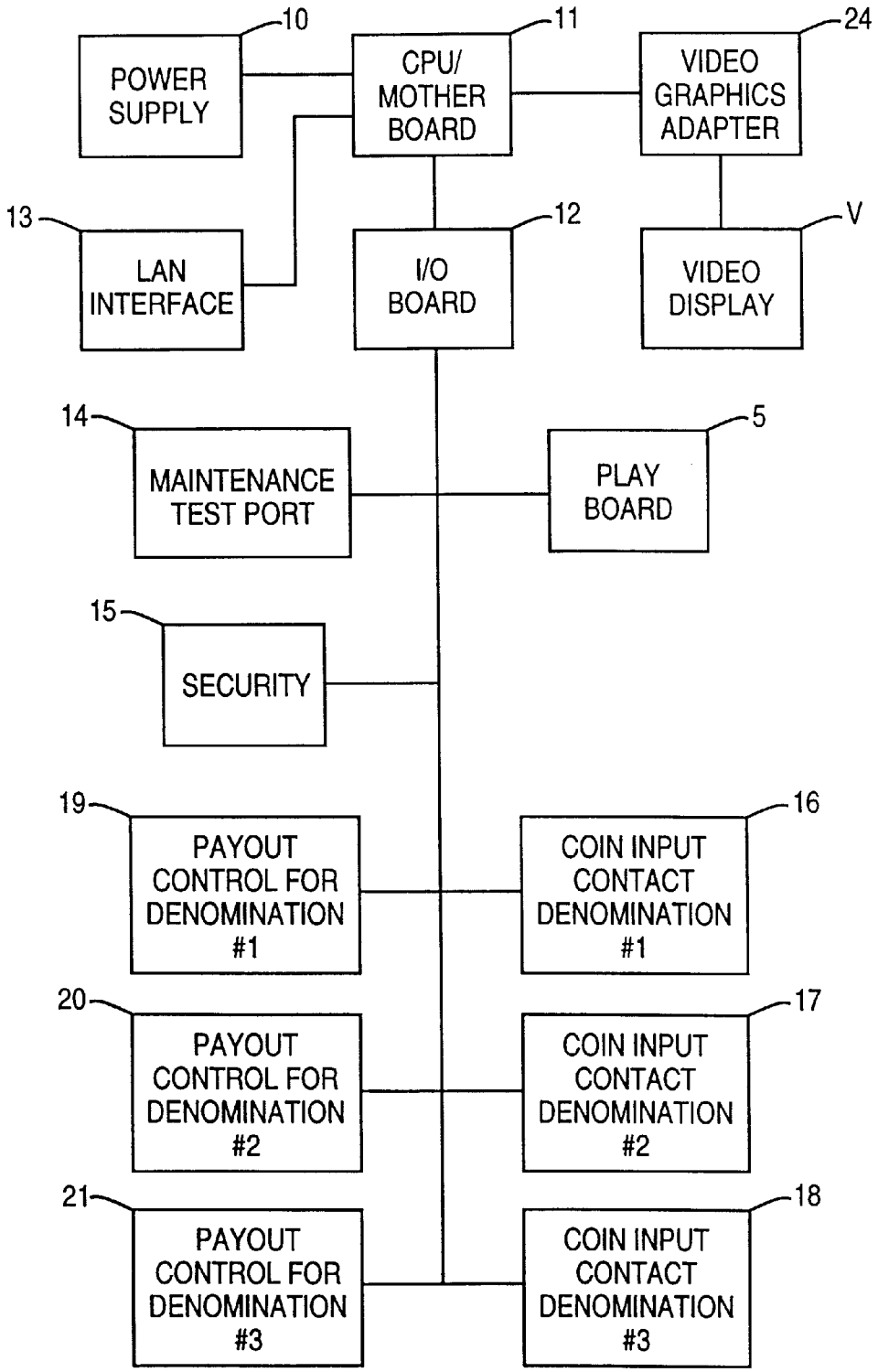
FIG. 2 is a block diagram showing the components of the machine.

Referring to FIG. 2, a block diagram is shown, illustrating the various components of an apparatus as depicted generally in FIG. 1.

These components involve a power supply unit 10 which typically converts AC line current to a desired DC voltage for supplying power to the system.

Figure 3A:
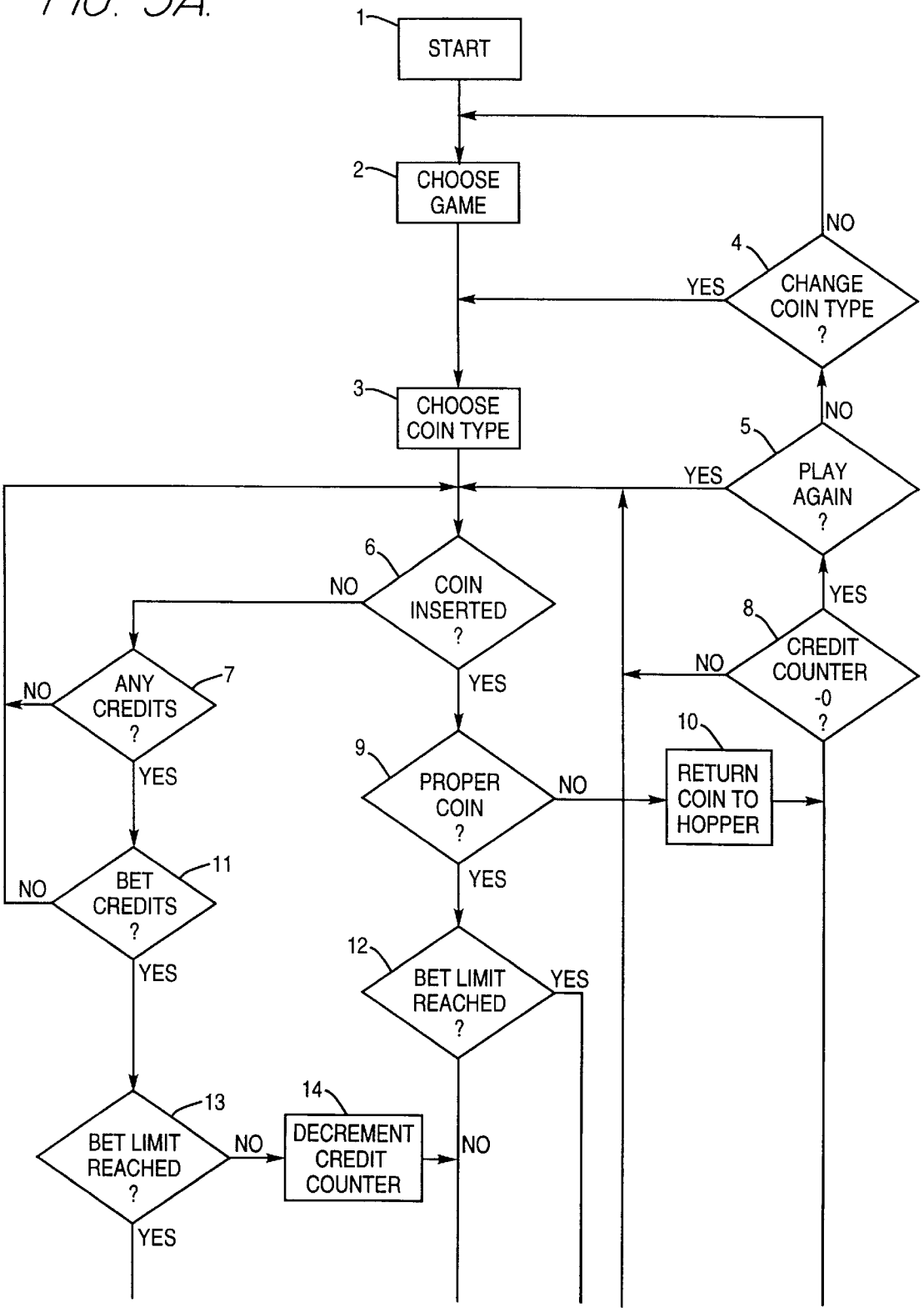
FIG. 3 is a flow chart illustrating the functioning of the machine.
Figure 3B:
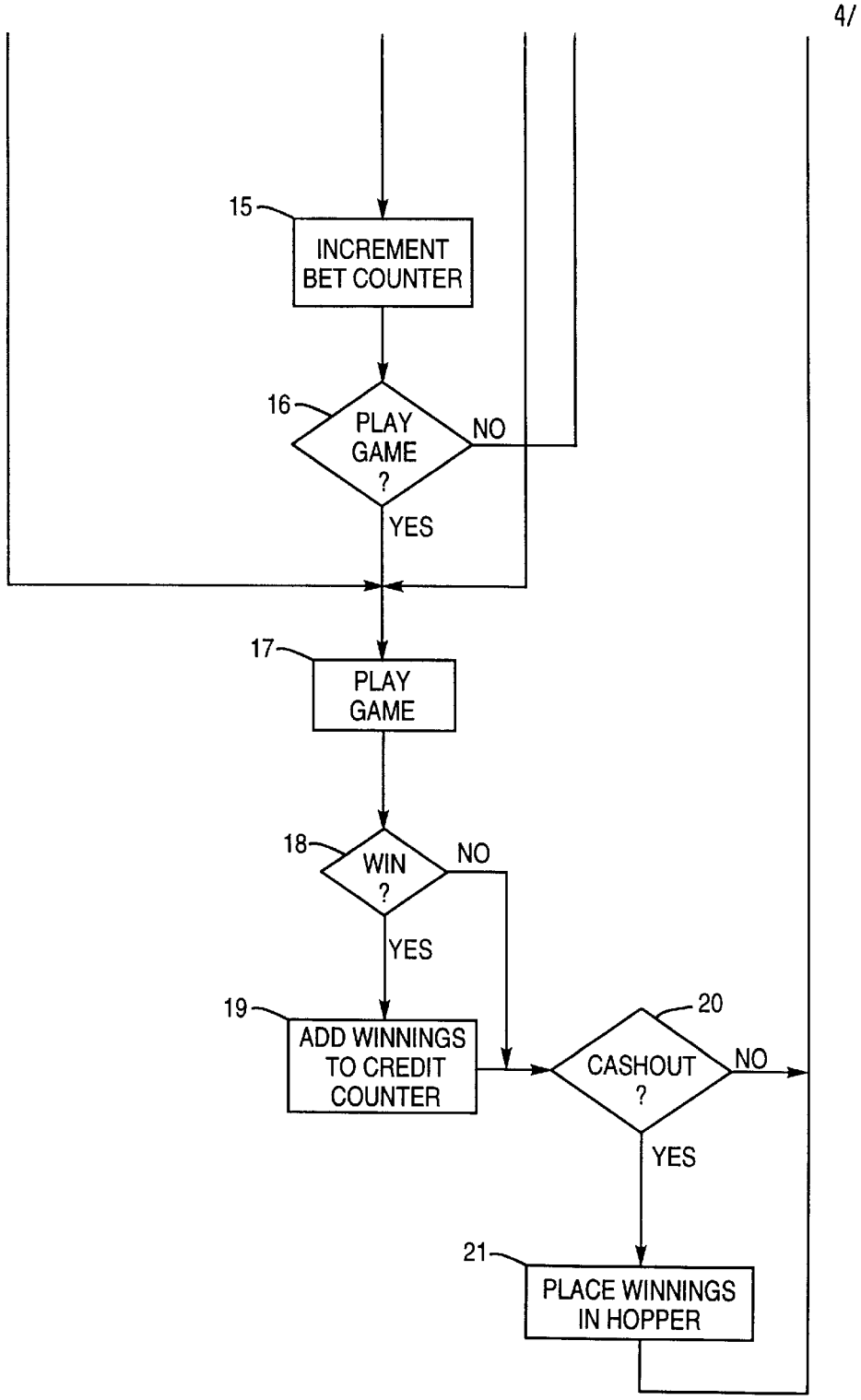
Figure 4A:
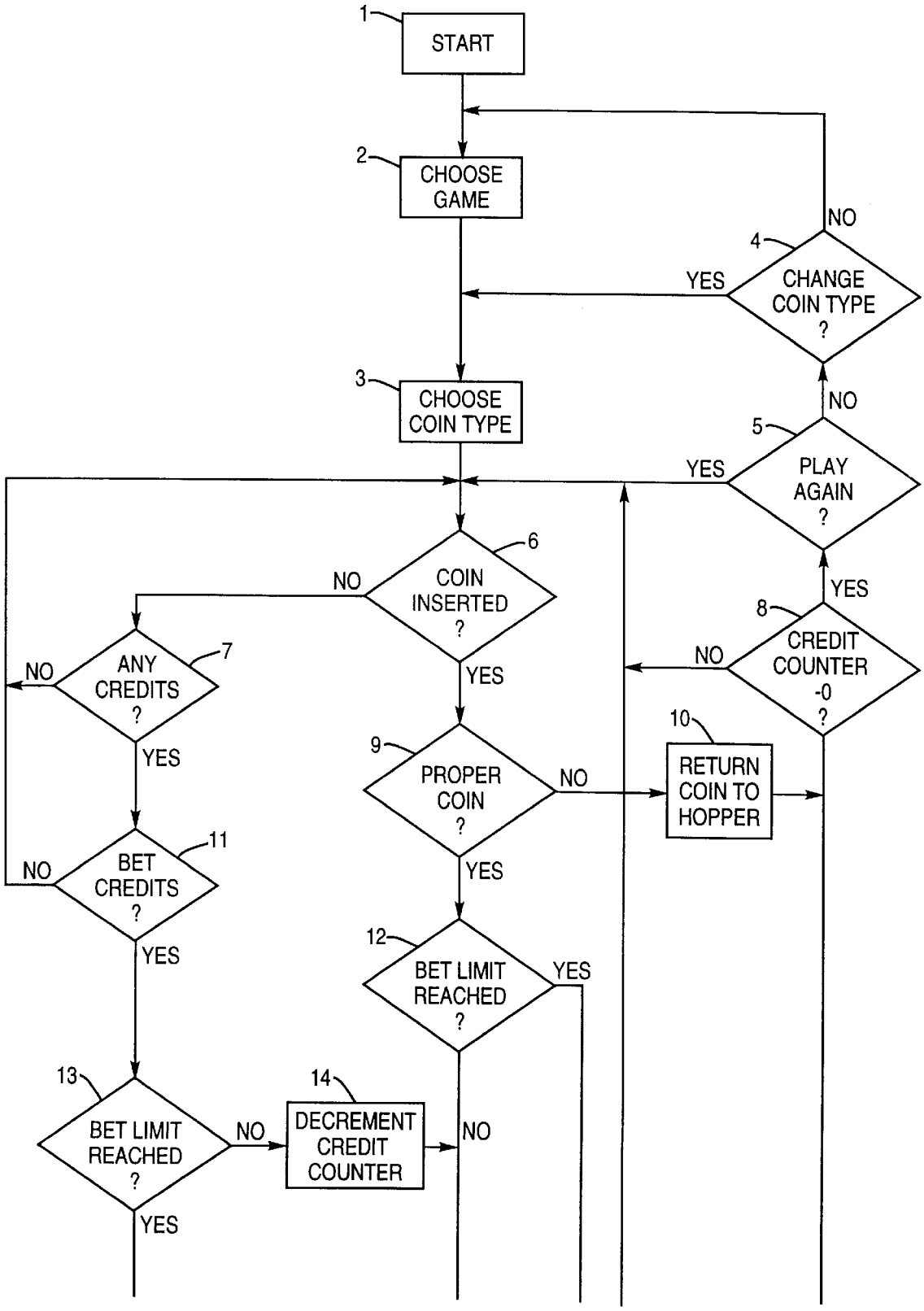
FIG. 4 is a flow chart showing a variation of the functioning of the machine as in FIG. 3, but with the addition of the function of considering a side bet prior to playing the game.
Figure 4B:
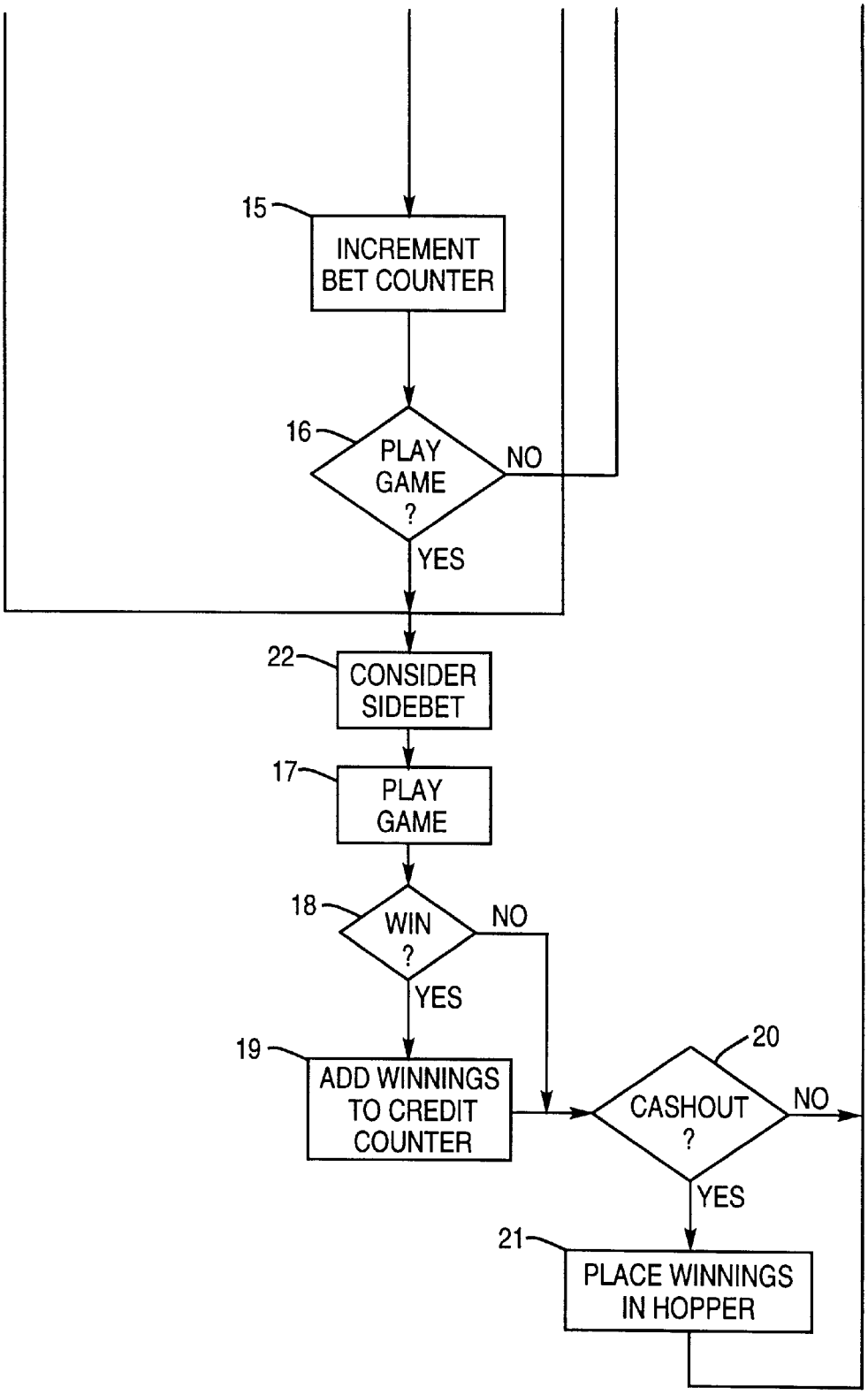
Figure 5:
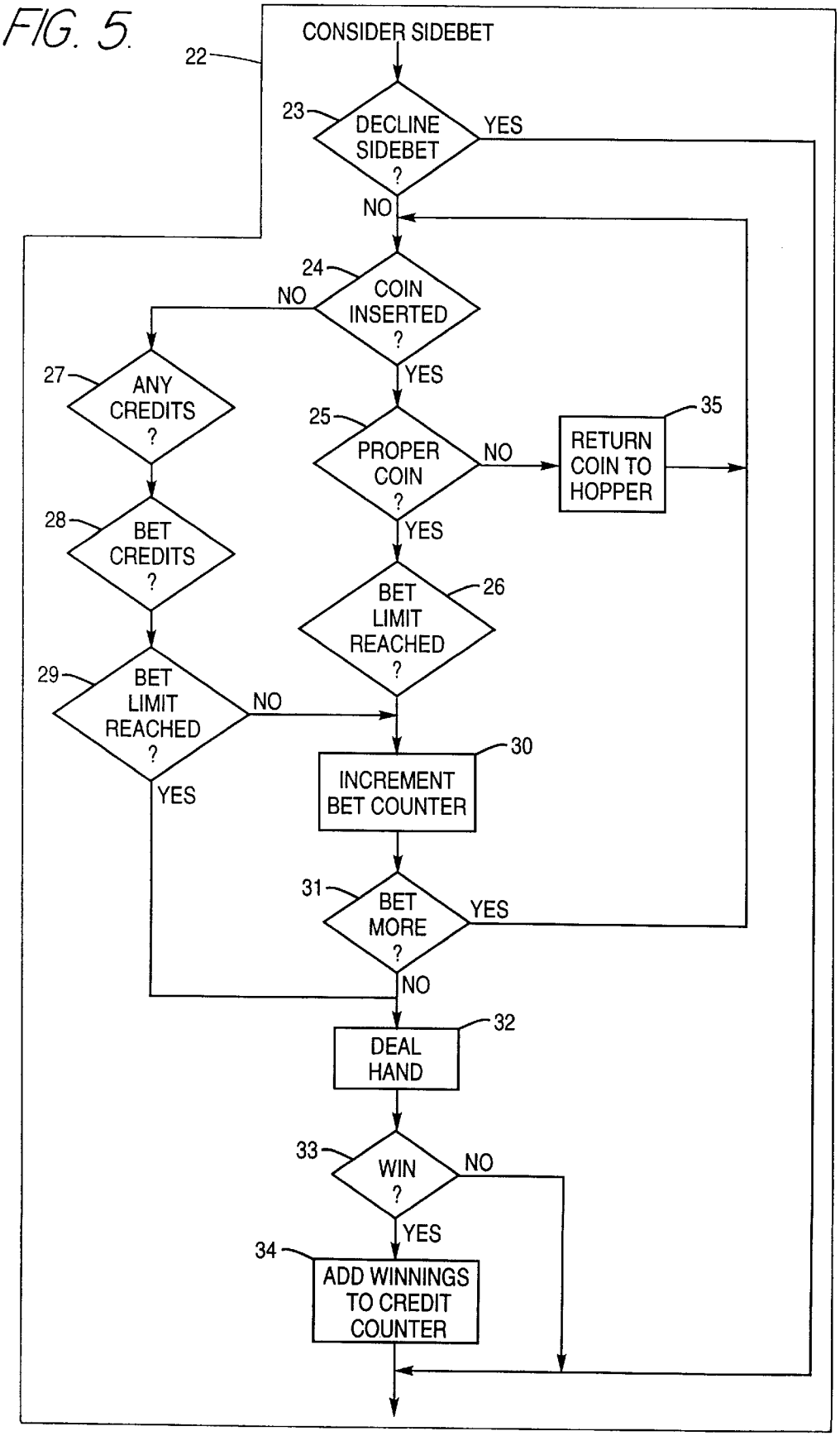
FIG. 5 is a flow chart showing the functioning of the machine upon selection of the opportunity of playing a side bet.

A central processing unit or CPU "MOTHERBOARD" 11 which will be more fully described as to its functions with reference to FIG. 3, and also in FIGS. 4 and 5 with respect to like bets, is interconnected with and controls a video graphics adaptor or "VGA VIDEO DRIVER 24" for the video display unit V, all in response to various components for playing, monitoring and interfacing the apparatus with a control center and protecting the apparatus.

An input/output unit or "I/O BOARD" 12 is adapted to transmit to the CPU 11 instructions from the various components which, in a preferred form, would include a networking interface unit or "LAN INTERFACE" 13 whereby the gaming apparatus operations may be communicated with a central control or data collection and monitoring location.

At 14 and 15 it will be seen that it may be desired that a "MAINTENANCE TEST PORT" and a "SECURITY" unit may be included in the system to preclude tampering with the other signal producing components.

The major game playing components of the system, as indicated above, include the manually operated play controlling board 5, together with "COIN INPUT CONTROL DENOMINATORS" 16, 17 and 18 which are respectively associated with the coin input slots 1, 2 and 3 referred to in FIG. 1 and which are adapted to either recognize upon insertion of a coin its acceptable denomination or which may be collectively combined to provide means responsive to the selected coin denomination button or pad 6-8 for establishing the level of the coin denomination being played.

Similarly, at 19, 20 and 21 are illustrated "PAY OUT CONTROL FOR DENOMINATIONS" #1, #2 and #3 which are employed to regulate the respective coinage pay out dependent upon the denomination of the coin played and which provide means responsive to the inputted coins either inserted for the mutual bet or any side bet, to regulate the number of coins won by the player.

Referring to FIG. 3 a flow chart is illustrated relating to the playing of the game with any one of the selected coin denominations, the selection of the game to be played and the variables related to the functions controlled by the CPU MOTHERBOARD 11 pursuant to input derived from the playboard 5 to pay out in the same local coinage denominations or to continue play with coins of the same or a different denomination or by betting credits won.

Step 1 is the start of a gaming sequence.

Step 2 allows the user to pick one of several games. By using input means 6-9, the display means may be caused to sequentially display the various games available, and input means 6-9 allows selection of one of the games. After a game is chosen, at step 3 coinage is selected at button 6-8 and the selection recognized at step 4. This decision may be made by placing the desired coin in the specific slot for that denomination at step 3. Of course a single slot could be used in conjunction with a multi-denominational sorting means.

Having chosen the denomination of coin, step 6 allows for playing based on the coin played.

As the coin is inserted we pass from step 6 to step 9, the coin selector validates that a proper coin has been inserted. If not, at step 10 the coin is rejected. Assuming a valid coin, the machine checks to determine whether the bet limit is reached. If not, we pass to step 15 and increment the bet counter.

At step 16 playing is enabled. Assuming that the desired number of coins have been inserted we go to step 17 where the input means and output means are used to play the game.

At the conclusion of the game in step 18, the winnings, if any, are added to the credit counter. At that point, the user can move to step 20 and cash out or continue to play.

We then pass to step 8 where the credit counter is checked to see if it is equal to zero. If it is equal to zero, we go to step 5 where the user is offered the option to play the same game again or to choose a different game, or, the decision can be made to change the coin denomination in step 3 which returns the user to step 4 for playing the same game but with the same or a different denomination.

At step 6, if a coin is not inserted, we pass to step 7 where the number of credits is checked. If credits exist, the input means is used to wager credits at step 1. In step 13, if the bet limit is not reached, we pass to step 14 where the credit counter is decremented and the bet counter is incremented. However, upon entering step 13, if the bet limit has been reached we pass to step 17 where game play can begin.

At step 6, when a coin is inserted, if it is a proper coin we proceed to step 12. If the bet limit has been reached then we pass immediately to step 17 where game play can begin.

At the conclusion of the game, the opportunity to cash out in step 20 is presented. If the decision is made to cash out by acting upon the input means, step 21 places the remaining credit and winnings into the hopper.

At each point in the flow chart, those push buttons which have a function are illuminated. Those which have no function at that particular point in the flow chart are not illuminated. Furthermore, during the play of the game, it is possible to change the label on switches, depending upon the events of the game, enabling fewer switches to allow all choices to be made without having to reserve a specific switch for a specific function. This allows greater flexibility with less complication. In the preferred embodiment there are as many switches as the maximum number of decisions that can be made at any point in the game so that the user need only press a single button for any decision. On the other hand, as will be understood below, the decision to make a side bet may be initiated simply by inserting a coin or using credits of the necessary amount equally or less than the amount required or permitted in side bet case.

Referring now to FIGS. 4 and 5, it will be recognized that the various card games or conceivable other games within the purview of the invention may be played in such a manner as to enable the placing of "side bets". Various types of side bets may be made depending upon the game being played, including, without limitation, such as in poker or black jack, betting on receiving a pair of cards of the same suit or, as in the case of black jack, side betting for insurance, splitting pairs, doubling down on numbers near 10, or the like.

In FIG. 4, the logic of betting any game played corresponds with that described with respect to FIG. 3, but with the exception that there is a block 22 in the flow chart at which the function is to enable the player to make the side bet within some predetermined period of time, thereby expediting game play and initiating the appropriate side bet, depending upon the nature thereof.

The appropriate button or pad on the control panel will be understood from the foregoing, may indicate to the player that the opportunity to make the side bet is present.

Referring to FIG. 5, the function of block 23 is more particularly illustrated as a subset of the diagram of FIG. 4. The next step in the process of the progress of the game would be for a player to decide at block 23 to decline a side bet as a result of which there could be no winning of a side bet, and the balance of the functions in FIG. 5 become irrelevant as to the playing of the game as previously described with respect to FIG. 3, i.e., determining whether the game has been won and the winnings are to be either credited or cashed out.

On the other hand, in the event that a player decides to make a side bet, the possible side bets may be displayed on the screen and the side bet selected may either be designated by depressing of a pad or button on the front panel and the side bet may be initiated by the insertion of a coin at 24, unless credits are to be employed for the side bet under the control of blocks 27, 28 and 29.

Otherwise, the propriety of the coin inserted for purpose of playing a side bet will be determined at 25 and either returned to the hopper if incorrect, at 35, or incremented by the bet limit and bet counter at 26 and 38, as well as at 31 so as to enable the side bet to be effectively concluded.

Thereafter, block 32 controls the dealing of the hand by which the side bet can be determined to be won or lost in conjunction with the playing of the game at 17 in the flow chart of FIG. 4 and the calculations of game winnings at 18 in FIG. 4 and side bet winnings at 33 in FIG. 5, if indeed such winnings exist.

At 10 in FIG. 4 and 34 in FIG. 5 the winnings are either added to the credit counter, or, if the game or side bet has been won, the winnings may be cashed out as in FIG. 4 and placed in the hopper.

From the foregoing, it will now be apparent that the gaming machine, as herein disclosed, affords multiple and various opportunities for the pleasure of those interested in the playing of gaming machines and wherein many of the gaming characteristics available at card tables may be engaged by the player, utilizing the coins of different denominations as permitted by the multiple coin receiver capacity and pair capacity of the game apparatus.

We claim:

1. A gaming machine for playing games responsive to the play of coins of a plurality of denominations of a local currency and operable to pay out in the same coins and denominations, comprising game display means, a plurality of means for separately and individually receiving and collecting a bet only of coins of a selected one of a plurality of denominations, means for manually directing the playing of the displayed game, and means for paying out from said means for receiving and collecting coins of the selected one of a plurality of denominations the winnings in the same coins bet.

2. A gaming machine as defined in claim 1, wherein said game display means displays a selected one of a plurality of games.

3. A gaming machine as defined in claim 1, wherein said game display means display a selected one of a plurality of games, and said means for manually directing the playing of said one of a plurality of games includes individual manual selectors which display the play options for the selected games.

4. A gaming machine as defined in claim 1, including means for interfacing the means for paying out winnings with a control and monitoring station.

5. A gaming machine as defined in claim 1, wherein said game display means displays a selected one of a plurality of games, including means for interfacing said display means with a control and monitoring system.

6. A gaming machine as defined in claim 1, including means enabling the playing of side bets on the game being played prior to playing the game in such denomination as is required by the game.

7. A gaming machine for playing one of a number of selected games responsive to the play of bets of different denominations of currency and operable to pay out in the same coins and denominations, comprising game display means for displaying a number of games, means for selecting one of said number of games, means for separately and individually receiving and collecting only a bet of coins of a selected one of a plurality of denominations on the selected game means for indicating the opportunity for a side bet before conclusion of the game selected and depending upon the selected game, and means for accepting the currency necessary to make the side bet, means for determining the winnings resulting from the side bet and resulting from play of the selected game, and means for determining the winnings, if any, resulting from either the side bet, the selected game or the combination thereof and means for paying out from said means for receiving and collecting coins of the selected one of a plurality of denominations the winnings on the selected game and the side bet in the same coins bet.

* * * * *